US009202663B2

(12) United States Patent
Yoshizawa

(10) Patent No.: US 9,202,663 B2
(45) Date of Patent: Dec. 1, 2015

(54) FLAT FILAMENT FOR AN X-RAY TUBE, AND AN X-RAY TUBE

(71) Applicant: SHIMADZU CORPORATION, Kyoto-shi, Kyoto (JP)

(72) Inventor: Tatsuya Yoshizawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 286 days.

(21) Appl. No.: 13/706,145

(22) Filed: Dec. 5, 2012

(65) Prior Publication Data

US 2014/0153698 A1 Jun. 5, 2014

(51) Int. Cl.
*H01J 35/06* (2006.01)

(52) U.S. Cl.
CPC ..... *H01J 35/06* (2013.01)

(58) Field of Classification Search
CPC ..... H01J 35/14; H01J 1/16; H01J 2235/068; H01J 2235/1212; H01J 2201/2803; H01J 2201/2878
USPC ..... 378/136–138, 119, 141, 346 R
See application file for complete search history.

(56) References Cited

U.S. PATENT DOCUMENTS

| | | | | |
|---|---|---|---|---|
| 6,115,453 | A | 9/2000 | Hell et al. | |
| 6,426,587 | B1 * | 7/2002 | Hell et al. | 313/341 |
| 7,062,017 | B1 * | 6/2006 | Runnoe | 378/136 |
| 7,693,265 | B2 * | 4/2010 | Hauttmann et al. | 378/136 |
| 8,175,222 | B2 * | 5/2012 | Moore et al. | 378/136 |
| 8,247,971 | B1 * | 8/2012 | Bard et al. | 313/631 |
| 2003/0025429 | A1 * | 2/2003 | Hell et al. | 313/310 |
| 2006/0274880 | A1 * | 12/2006 | Oikawa et al. | 378/21 |
| 2009/0129550 | A1 * | 5/2009 | Bandy et al. | 378/141 |
| 2010/0176708 | A1 * | 7/2010 | Hauttmann | 313/310 |
| 2010/0195797 | A1 * | 8/2010 | Hauttmann | 378/136 |
| 2010/0195800 | A1 * | 8/2010 | Freudenberger | 378/138 |
| 2010/0207508 | A1 * | 8/2010 | Terletska et al. | 313/341 |
| 2011/0188637 | A1 * | 8/2011 | Lemaitre et al. | 378/136 |
| 2014/0079187 | A1 * | 3/2014 | Zhang et al. | 378/136 |

FOREIGN PATENT DOCUMENTS

JP 5-067442 A 3/1993

* cited by examiner

*Primary Examiner* — Brooke Purinton
(74) *Attorney, Agent, or Firm* — McDermott Will & Emery LLP

(57) ABSTRACT

A flat filament includes a first electron emission surface, a first current supply leg, a second current supply leg, a second electron emission surface disposed laterally of the first electron emission surface and connected to a first end region of the first electron emission surface, a third current supply leg, a third electron emission surface disposed laterally of the first electron emission surface, opposite from the second electron emission surface, and connected to a second end region of the first electron emission surface, and a fourth current supply leg.

21 Claims, 5 Drawing Sheets

FLAT FILAMENT FOR AN X-RAY TUBE, AND AN X-RAY TUBE

BACKGROUND OF THE INVENTION

1. Field of the Invention

This invention relates to a flat filament for an X-ray tube, and an X-ray tube.

2. Description of the Prior Art

An X-ray tube used in an X-ray apparatus for medical purposes includes a cathode for generating an electron beam, and an anode for generating X-rays upon collision with the electron beam generated from the cathode. The cathode uses a flat filament having an electron emission surface and a pair of current supply legs connected to the electron emission surface (Japanese Unexamined Patent Publication H5-67442 and the specification of U.S. Pat. No. 6,115,453).

FIG. 5 is a schematic view of such a conventional flat filament 71.

This flat filament 71 includes an electron emission surface 72 having two bent parts, and a pair of current supply legs 73 and 74 connected to the electron emission surface 72. The flat filament 71, with the pair of current supply legs 73 and 74 bent at right angles in positions shown in dashed lines in FIG. 5, is attached to a focusing electrode.

FIG. 6 is a schematic view of a flat filament 75 described in the specification of U.S. Pat. No. 6,115,453.

This flat filament 75 is provided to secure a longer lifetime, and includes an electron emission surface 76 having a plurality of regions in the shape of concentric circles, and a pair of current supply legs 77 and 78 connected to the electron emission surface 76. This flat filament 75 also, with the pair of current supply legs 77 and 78 bent at right angles in positions shown in dashed lines in FIG. 6, is attached to a focusing electrode.

An X-ray tube which uses each of the flat filaments noted above can obtain only a focus of fixed size corresponding to the size of the electron emission surface of the flat filament. Therefore, when such flat filament is used, it is difficult to realize an X-ray tube having a plurality of focus sizes.

With an X-ray apparatus for medical purposes, on the other hand, it is preferable to change focus sizes according to patients to be X-rayed. That is, it is preferable to reduce the focus size for X-raying minute sites, for example. When X-raying a patient of large body thickness, or when conducting X-raying with a reduced load on the anode, it is preferable to enlarge the focus size.

Therefore, use is made also of an X-ray tube having a plurality of filaments arranged in the single X-ray tube, but this poses a problem of complicating the construction. With an X-ray tube of the envelope rotation type having an envelope containing a cathode and an anode, the anode being rotatable with the envelope, it is necessary to place a filament at the center of rotation of the anode and envelope. This limits installation of the filament to only one location, and hence a problem that a plurality of filaments cannot be arranged.

SUMMARY OF THE INVENTION

The object of this invention, therefore, is to provide a flat filament capable of generating thermoelectrons which can form a plurality of focus sizes while using the single flat filament, and an X-ray tube using this flat filament.

The above object is fulfilled, according to this invention, by a flat filament for an X-ray tube, comprising a first electron emission surface; a first current supply leg connected to a first end region of the first electron emission surface; a second current supply leg connected to a second end region opposite from the first end region of the first electron emission surface; a second electron emission surface disposed laterally of the first electron emission surface and connected to the first end region of the first electron emission surface; a third current supply leg connected to a second end region of the second electron emission surface; a third electron emission surface disposed laterally of the first electron emission surface, opposite from the second electron emission surface, and connected to the second end region of the first electron emission surface; and a fourth current supply leg connected to a first end region of the third electron emission surface.

With such a flat filament for an X-ray tube, it is possible to generate thermoelectrons which can form focuses of different sizes by supplying a heating current selectively to the first and second current supply legs and to the third and fourth current supply legs. This realizes an X-ray tube which can emit X-rays of different focus sizes while using a single filament.

In a preferred embodiment, heat radiation areas of reduced heat conduction are formed in the second electron emission surface adjacent a connection thereof to the first electron emission surface, and in the third electron emission surface adjacent a connection thereof to the first electron emission surface.

With this construction, by action of the heat radiation areas of reduced heat conduction, it is possible to decrease the rate at which the thermal energy produced in the first electron emission surface when the current is supplied to the first and second current supply legs escapes to the second electron emission surface and third electron emission surface.

In another preferred embodiment, the flat filament further comprises a fourth electron emission surface disposed laterally of the second electron emission surface, opposite from the first electron emission surface, and connected to the second end region of the second electron emission surface; a fifth current supply leg connected to a first end region of the fourth electron emission surface; a fifth electron emission surface disposed laterally of the third electron emission surface, opposite from the first electron emission surface, and connected to the first end region of the third electron emission surface; and a sixth current supply leg connected to a second end region of the fifth electron emission surface.

With this construction, it is possible to generate thermoelectrons capable of forming focuses of three different sizes by supplying the heating current selectively to the first and second current supply legs, to the third and fourth current supply legs, and to the fifth and sixth current supply legs. Thus, it is possible to realize an X-ray tube which emits X-rays of three different focus sizes, while using a single filament.

The object noted hereinbefore is fulfilled, according to this invention, by an X-ray tube having a cathode with a flat filament for generating an electron beam, and an anode for generating X-rays upon collision with the electron beam generated from the cathode, wherein the flat filament includes a first electron emission surface; a first current supply leg connected to a first end region of the first electron emission surface; a second current supply leg connected to a second end region opposite from the first end region of the first electron emission surface; a second electron emission surface disposed laterally of the first electron emission surface and connected to the first end region of the first electron emission surface; a third current supply leg connected to a second end region of the second electron emission surface; a third electron emission surface disposed laterally of the first electron emission surface, opposite from the second electron emission surface, and connected to the second end region of the first electron emission surface; and a fourth current supply leg connected to a first end region of the third electron emission surface; the X-ray tube comprising a heating current supply source for supplying a heating current selectively to the first and second current supply legs and to the third and fourth current supply legs.

With such an X-ray tube, it is possible to generate thermoelectrons which can form focuses of different sizes by supplying the heating current from the heating current supply source selectively to the first and second current supply legs and to the third and fourth current supply legs. This realizes an X-ray tube which can emit X-rays of different focus sizes while using a single filament.

In a different aspect of this invention, there is provided an X-ray tube of envelope rotation type having a cathode with a flat filament for generating an electron beam, an anode for generating X-rays upon collision with the electron beam generated from the cathode, a deflection coil for controlling a focal position where the electron beam collides with the anode by deflecting the electron beam generated from the cathode, and an envelope containing the cathode and the anode, the anode being rotatable with the envelope, wherein the flat filament includes a first electron emission surface; a first current supply leg connected to a first end region of the first electron emission surface; a second current supply leg connected to a second end region opposite from the first end region of the first electron emission surface; a second electron emission surface disposed laterally of the first electron emission surface and connected to the first end region of the first electron emission surface; a third current supply leg connected to a second end region of the second electron emission surface; a third electron emission surface disposed laterally of the first electron emission surface, opposite from the second electron emission surface, and connected to the second end region of the first electron emission surface; and a fourth current supply leg connected to a first end region of the third electron emission surface; the X-ray tube comprising a heating current supply source for supplying a heating current selectively to the first and second current supply legs and to the third and fourth current supply legs.

According to such an X-ray tube, which is an envelope rotation type X-ray tube with an envelope containing a cathode and an anode, the anode being rotatable with the envelope, a filament having a first, a second and a third electron emission surface is placed at the center of rotation of the anode and envelope. It is possible to generate thermoelectrons which can form focuses of different sizes by supplying the heating current from the heating current supply source selectively to the first and second current supply legs and to the third and fourth current supply legs. This realizes an envelope rotation type X-ray tube which can emit X-rays of different focus sizes while using a single filament.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
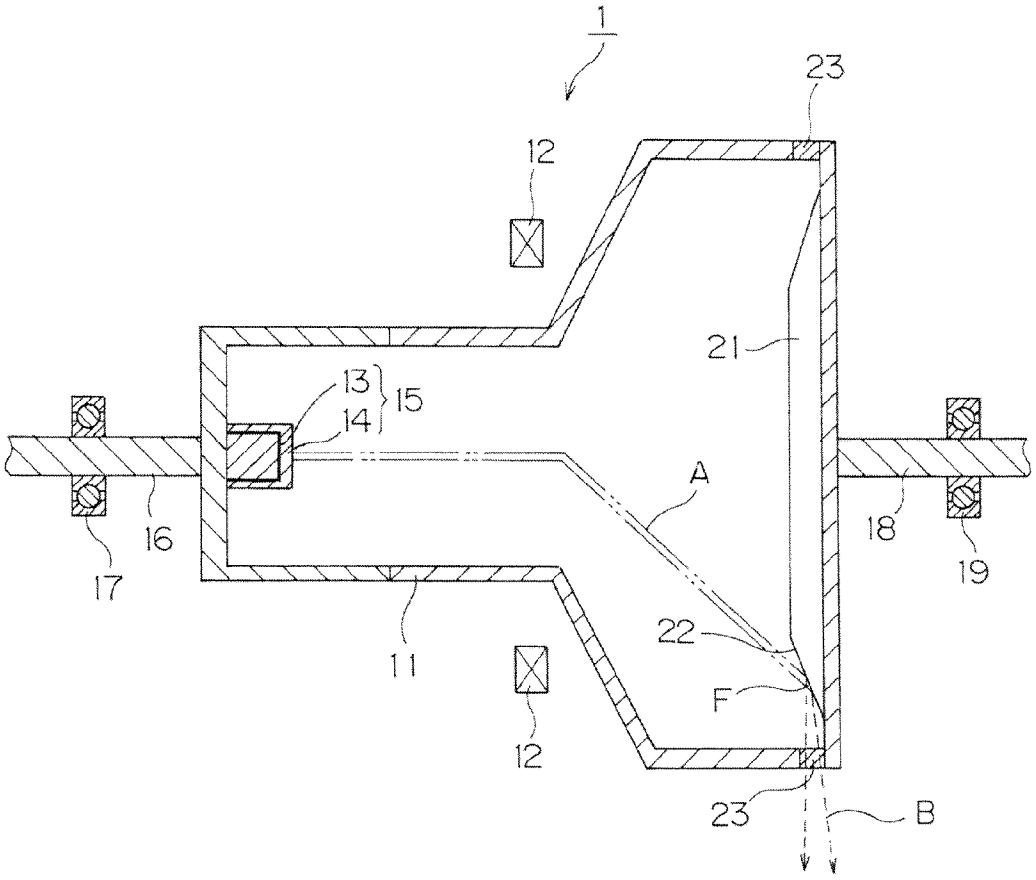
FIG. 1 is a schematic view of an X-ray tube according to this invention.

FIG. 1 is a schematic view of an X-ray tube 1 according to this invention.

This X-ray tube 1 is the envelope rotation type, and includes an envelope 11 having a vacuumed interior. The housing 11 has, disposed therein, a cathode 15 for generating an electron beam A, the cathode 15 including a flat filament 13 according to this invention which is heated to high temperature to release thermoelectrons, and a focusing electrode 14 with a groove in which the flat filament 13 is mounted. The envelope 11 has an anode 21 disposed on an end surface thereof opposed to the cathode 15, for generating X-rays B upon collision with the electron beam A generated from the cathode 15. High voltage is applied to the cathode 15 and anode 21 by a slip ring mechanism, not shown, through a cathode-side rotary shaft 16 and an anode-side rotary shaft 18. The cathode-side rotary shaft 16 and anode-side rotary shaft 18 are respectively supported by bearings 17 and 19. The envelope 11 is rotatable with the cathode 15 and anode 21 about the cathode-side rotary shaft 16 and anode-side rotary shaft 18 by drive of a motor not shown.

Thermoelectrons generated in the heated flat filament 13 are focused by the focusing electrode 14 to generate the electron beam A from the cathode 15. This electron beam A is accelerated toward the anode 21 by action of an electric field formed by the high voltage. And this electron beam A is deflected by action of a deflection coil 12 disposed circumferentially of the envelope 11, and collides at focus F with a target disk slope 22 of the anode 21, thereby to generate the X-rays B. These X-rays B are emitted outward from emission apertures 23 formed in the envelope 11. The position of focus F where the electron beam A collides with the anode 21 can be changed by controlling the current applied to the deflection coil 12.

Figure 2:
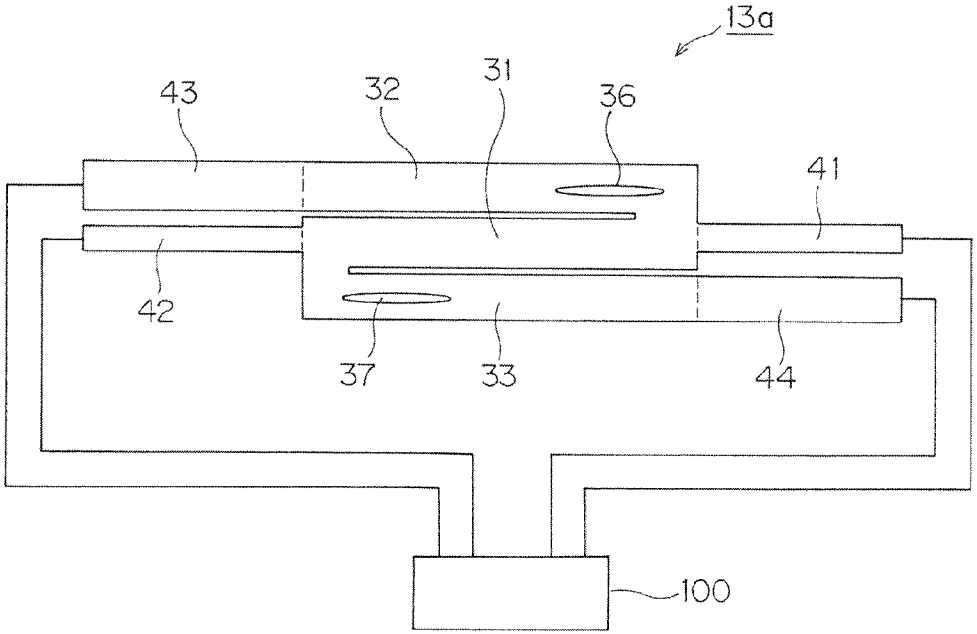
FIG. 2 is an explanatory view showing a flat filament according to a first embodiment of this invention along with a heating current supply source.

FIG. 2 is an explanatory view showing a flat filament **13*a* according to a first embodiment of this invention along with a heating current supply source 100**.

This flat filament **13*a* includes a first electron emission surface 31, a first current supply leg 41 connected to a first end region (right end region in FIG. 2) of the first electron emission surface 31, a second current supply leg 42 connected to a second end region (left end region in FIG. 2) opposite from the first end region of the first electron emission surface 31, a second electron emission surface 32 disposed laterally (upward in FIG. 2) of the first electron emission surface 31 and connected to the first end region of the first electron emission surface 31, a third current supply leg 43 connected to a second end region of the second electron emission surface 32, a third electron emission surface 33 disposed laterally (downward in FIG. 2) of the first electron emission surface 31, opposite from the second electron emission surface 32, and connected to the second end region of the first electron emission surface 31, and a fourth current supply leg 44 connected to a first end region of the third electron emission surface 33. The flat filament 13***a*, with the first, second, third and fourth current supply legs 41, 42, 43 and 44 bent at right angles in positions shown in dashed lines in FIG. 2, is attached to the focusing electrode 14.

The second electron emission surface 32 has a bore 36 formed adjacent the connection to the first electron emission surface 31, to provide a heat radiation area of reduced heat conduction. Similarly, the third electron emission surface 33 has a bore 37 formed adjacent the connection to the first electron emission surface 31, to provide a heat radiation area of reduced heat conduction.

The first current supply source 41, second current supply leg 42, third current supply leg 43 and fourth current supply leg 44 are respectively connected to the heating current supply source 100. The heating current supply source 100 is constructed to supply a heating current selectively to the first and second current supply legs 41 and 42 and to the third and fourth current supply legs 43 and 44 in response to signals from a controller which controls the X-ray tube 1.

With the flat filament 13*a* having the above construction, when the heating current is supplied to the first current supply leg 41 and second current supply leg 42, the first electron emission surface 31 is heated and thermoelectrons are released from this first electron emission surface 31. On the other hand, when the heating current is supplied to the third current supply leg 43 and fourth current supply leg 44, all of the first electron emission surface 31, second electron emission surface 32 and third electron emission surface 33 are heated, and thermoelectrons are released from the first, second and third electron emission surfaces 31, 32 and 33.

Consequently, with the heating current supplied from the heating current supply source 100 selectively to the first and second current supply legs 41 and 42 and to the third and fourth current supply legs 43 and 44, it is possible to generate thermoelectrons capable of forming different size focuses. Thus, it is possible to realize the X-ray tube 1 which emits X-rays of different focus sizes, while using the single flat filament 13*a* disposed at the center of rotation of the anode 21 and envelope 11.

With this flat filament 13*a*, when the heating current is supplied to the first current supply leg 41 and second current supply leg 42, the first electron emission surface 31 is heated, but the second electron emission surface 32 and third electron emission surface 33 are not heated. It is therefore conceivable that the thermal energy produced in the first electron emission surface 31 escapes to the second electron emission surface 32 and third electron emission surface 33.

However, the bore 36 is formed in the second electron emission surface 32 adjacent the connection to the first electron emission surface 31, to provide a heat radiation area of reduced heat conduction, and the bore 37 is formed in the third electron emission surface 33 adjacent the connection to the first electron emission surface 31, to provide a heat radiation area of reduced heat conduction. This decreases the cross-sectional area of passages of heat serving as heat escape paths in the second and third electron emission surfaces 32 and 33. It is therefore possible to decrease the rate at which the thermal energy produced in the first electron emission surface 31 escapes to the second electron emission surface 32 and third electron emission surface 33.

It is possible to control a temperature distribution occurring to the flat filament 13*a* by adjusting the size of these bores 36 and 37, the width of the second and third electron emission surfaces 32 and 33 and the width of the first current supply leg 41 and second current supply leg 42, taking account of a heat gradient from the first electron emission surface 31 to the second electron emission surface 32 and third electron emission surface 33, for example.

In the foregoing embodiment, the heat radiation areas of reduced heat conduction are provided by forming the bores 36 and 37 in the second and third electron emission surfaces 32 and 33. Instead of the bores 36 and 37, recesses may be formed in opposite sides of the second and third electron emission surfaces 32 and 33 to reduce the width thereof, thereby to provide such heat radiation areas of reduced heat conduction. However, this will change the outer shapes of the second and third electron emission surfaces 32 and 33, which may change the focus shape.

Figure 3:
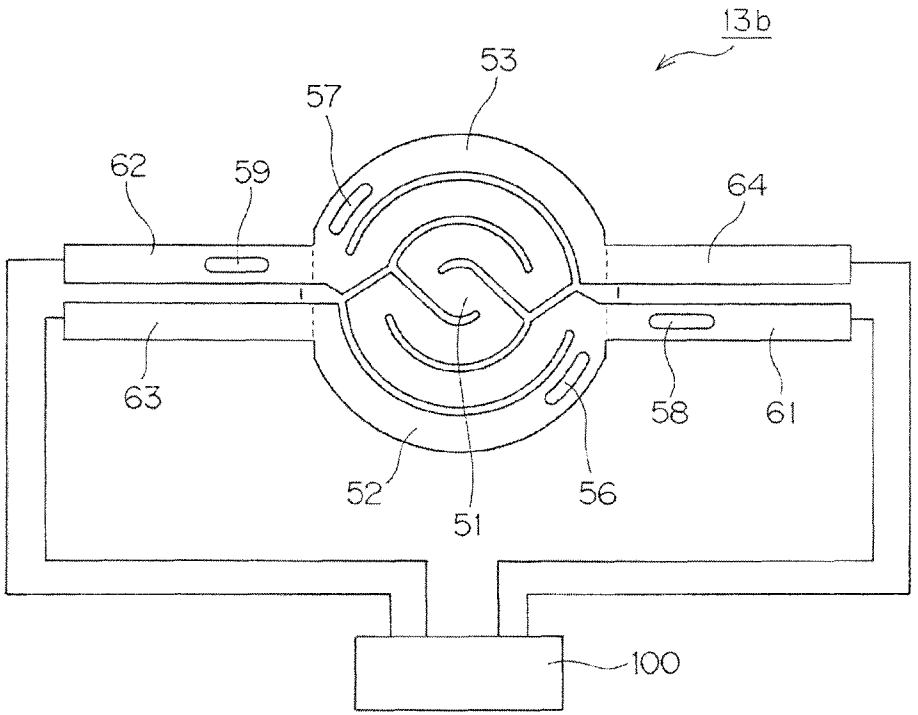
FIG. 3 is an explanatory view showing a flat filament according to a second embodiment of this invention along with the heating current supply source.

Next, another embodiment of the flat filament according to this invention will be described. FIG. 3 is an explanatory view showing a flat filament 13*b* according to a second embodiment of this invention along with the heating current supply source 100.

This flat filament 13*b* includes a first electron emission surface 51 having a plurality of areas in the shape of concentric circles, a first current supply leg 61 connected to a first end region (right end region in FIG. 3) of the first electron emission surface 51, a second current supply leg 62 connected to a second end region (left end region in FIG. 3) opposite from the first end region of the first electron emission surface 51, a second electron emission surface 52 disposed laterally (downward in FIG. 3) of the first electron emission surface 51 and connected to the first end region of the first electron emission surface 51, a third current supply leg 63 connected to a second end region of the second electron emission surface 52, a third electron emission surface 53 disposed laterally (upward in FIG. 3) of the first electron emission surface 51, opposite from the second electron emission surface 52, and connected to the second end region of the first electron emission surface 51, and a fourth current supply leg 64 connected to a first end of the third electron emission surface 53. The flat filament 13*b*, with the first, second, third and fourth current supply legs 61, 62, 63 and 64 bent at right angles in positions shown in dashed lines in FIG. 3, is attached to the focusing electrode 14.

The second electron emission surface 52 has a bore 56 formed adjacent the connection to the first electron emission surface 51, to provide a heat radiation area of reduced heat conduction. Similarly, the third electron emission surface 53 has a bore 57 formed adjacent the connection to the first electron emission surface 51, to provide a heat radiation area of reduced heat conduction. The first current supply leg 61 has a bore 58 formed therein to provide a heat radiation area of reduced heat conduction. Further, the second current supply leg 62 has a bore 59 formed therein to provide a heat radiation area of reduced heat conduction.

The first current supply leg 61, second current supply leg 62, third current supply leg 63 and fourth current supply leg 64 are respectively connected to the heating current supply source 100. The heating current supply source 100 is constructed to supply the heating current selectively to the first and second current supply legs 61 and 62 and to the third and fourth current supply legs 63 and 64 in response to the signals from the controller which controls the X-ray tube 1.

With the flat filament 13*b* having the above construction, as with the flat filament 13*a* according to the first embodiment, when the heating current is supplied to the first current supply leg 61 and second current supply leg 62, the first electron emission surface 51 is heated and thermoelectrons are released from this first electron emission surface 51. On the other hand, when the heating current is supplied to the third current supply leg 63 and fourth current supply leg 64, all of the first electron emission surface 51, second electron emission surface 52 and third electron emission surface 53 are heated, and thermoelectrons are released from the first, second and third electron emission surfaces 51, 52 and 53.

Consequently, with the heating current supplied from the heating current supply source 100 selectively to the first and second current supply legs 61 and 62 and to the third and fourth current supply legs 63 and 64, it is possible to generate thermoelectrons capable of forming different size focuses. Thus, it is possible to realize the X-ray tube 1 which emits X-rays of different focus sizes, while using the single flat filament 13*b* disposed at the center of rotation of the anode 21 and envelope 11.

In the flat filament 13*b* according to the second embodiment also, the bore 56 is formed in the second electron emission surface 52 adjacent the connection to the first electron emission surface 51, to provide a heat radiation area of reduced heat conduction, and the bore 57 is formed in the third electron emission surface 53 adjacent the connection to the first electron emission surface 51, to provide a heat radiation area of reduced heat conduction. This decreases the cross-sectional area of passages of heat serving as heat escape paths in the second and third electron emission surfaces 52 and 53. It is therefore possible to decrease the rate at which the thermal energy produced in the first electron emission surface 51 escapes to the second electron emission surface 52 and third electron emission surface 53.

Figure 4:
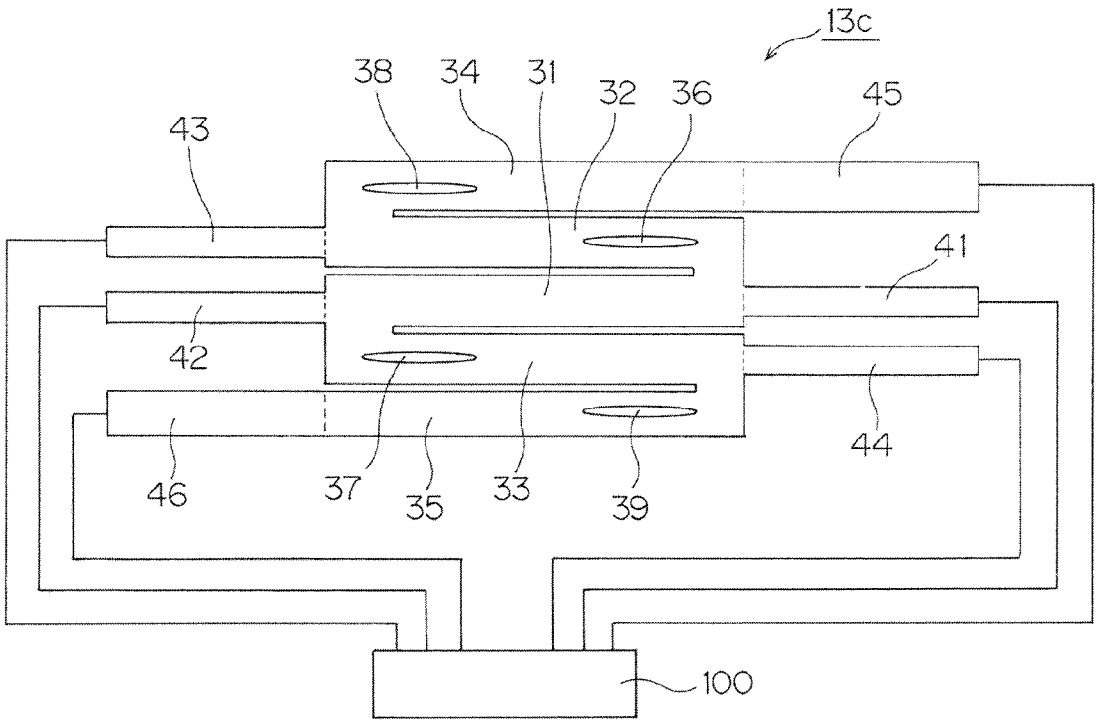
FIG. 4 is an explanatory view showing a flat filament according to a third embodiment of this invention along with the heating current supply source.
Figure 5:
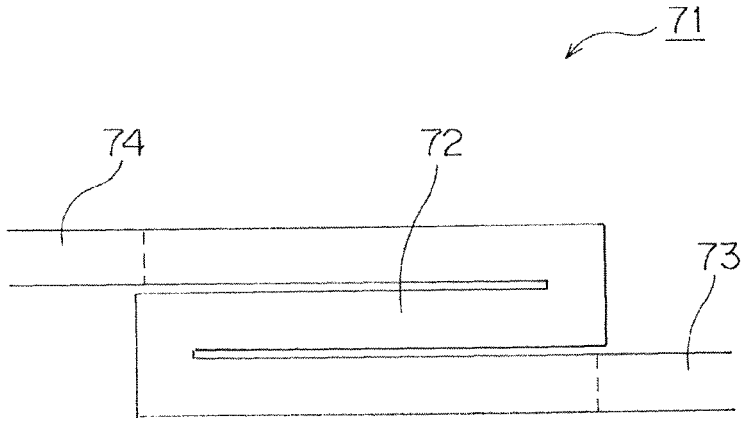
Fig. 5 Prior Art
FIG. 5 is a schematic view of a conventional flat filament 71.
Figure 6:
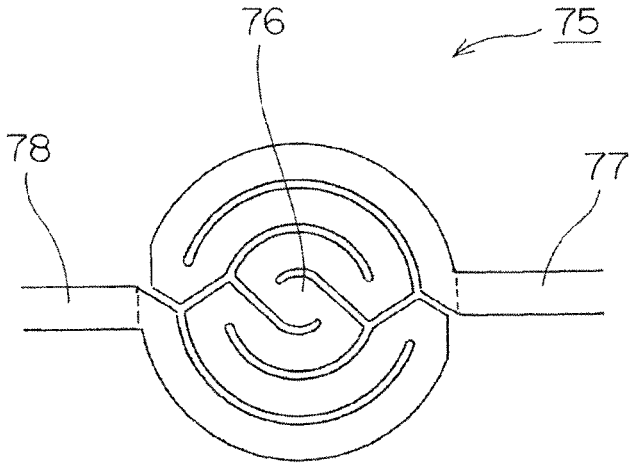
Fig. 6 Prior Art
FIG. 6 is a schematic view of a conventional flat filament 75.

Next, a further embodiment of the flat filament according to this invention will be described. FIG. 4 is an explanatory view showing a flat filament 13*c* according to a third embodiment of this invention along with the heating current supply source 100.

This flat filament 13*c* according to the third embodiment includes, as added to the flat filament 13*a* shown in FIG. 2, a fourth electron emission surface 34 disposed laterally (upward in FIG. 4) of the second electron emission surface 32, opposite from the first electron emission surface 31, and connected to the second end region (left end region in FIG. 4) of the second electron emission surface 32, a fifth current supply leg 45 connected to a first end region (right end region in FIG. 4) of the fourth electron emission surface 34, a fifth electron emission surface 35 disposed laterally (downward in FIG. 4) of the third electron emission surface 33, opposite from the first electron emission surface 31, and connected to a first end region of the third electron emission surface 33, and a sixth current supply leg 46 connected to a second end region of the fifth electron emission surface 35. The flat filament 13*c*, with the first, second, third, fourth, fifth and sixth current supply legs 41, 42, 43, 44, 45 and 46 bent at right angles in positions shown in dashed lines in FIG. 4, is attached to the focusing electrode 14.

The fourth electron emission surface 34 has a bore 38 formed adjacent the connection to the second electron emission surface 32, to provide a heat radiation area of reduced heat conduction. Similarly, the fifth electron emission surface 35 has a bore 39 formed adjacent the connection to the third electron emission surface 33, to provide a heat radiation area of reduced heat conduction.

The first current supply source 41, second current supply leg 42, third current supply leg 43, fourth current supply leg 44, fifth current supply leg 45 and sixth current supply leg 46 are respectively connected to the heating current supply source 100. The heating current supply source 100 is constructed to supply the heating current selectively to the first and second current supply legs 41 and 42, to the third and fourth current supply legs 43 and 44, and to the fifth and sixth current supply legs 45 and 46 in response to the signals from the controller which controls the X-ray tube 1.

With the flat filament 13*c* having the above construction, when the heating current is supplied to the first current supply leg 41 and second current supply leg 42, the first electron emission surface 31 is heated and thermoelectrons are released from this first electron emission surface 31. On the other hand, when the heating current is supplied to the third current supply leg 43 and fourth current supply leg 44, the first electron emission surface 31, second electron emission surface 32 and third electron emission surface 33 are heated, and thermoelectrons are released from the first, second and third electron emission surfaces 31, 32 and 33. Further, when the heating current is supplied to the fifth current supply leg 45 and sixth current supply leg 46, all of the first electron emission surface 31, second electron emission surface 32, third electron emission surface 33, fourth electron emission surface 34 and fifth electron emission surface 35 are heated, and thermoelectrons are released from the first, second, third, fourth and fifth electron emission surfaces 31, 32, 33, 34 and 35.

Consequently, with the heating current supplied from the heating current supply source 100 selectively to the first and second current supply legs 41 and 42, to the third and fourth current supply legs 43 and 44, and to the fifth and sixth current supply legs 45 and 46, it is possible to generate thermoelectrons capable of forming focuses in three different sizes. Thus, it is possible to realize the X-ray tube 1 which emits X-rays of three different focus sizes, while using the single flat filament 13*c* disposed at the center of rotation of the anode 21 and envelope 11.

In the flat filament 13*c* according to the third embodiment, the bore 38 is formed in the fourth electron emission surface 34 adjacent the connection to the second electron emission surface 32, to provide a heat radiation area of reduced heat conduction, and the bore 39 is formed in the fifth electron emission surface 35 adjacent the connection to the third electron emission surface 33, to provide a heat radiation area of reduced heat conduction. This decreases the cross-sectional area of passages of heat serving as heat escape paths in the fourth and fifth electron emission surfaces 34 and 35. It is therefore possible to decrease the rate at which the thermal energy produced in the second electron emission surface 32 escapes to the fourth electron emission surface 34, and the thermal energy produced in the third electron emission surface 33 escapes to the fifth electron emission surface 35.

This invention may be embodied in other specific forms without departing from the spirit or essential attributes thereof and, accordingly, reference should be made to the appended claims, rather than to the foregoing specification, as indicating the scope of the invention.

What is claimed is:

1. A flat filament for an X-ray tube, comprising:

a first electron emission surface;

a first current supply leg connected to a first end region of the first electron emission surface;

a second current supply leg connected to a second end region opposite from the first end region of the first electron emission surface;

a second electron emission surface disposed laterally of the first electron emission surface and connected to the first end region of the first electron emission surface;

a third current supply leg connected to a second end region of the second electron emission surface;

a third electron emission surface disposed laterally of the first electron emission surface, opposite from the second electron emission surface, and connected to the second end region of the first electron emission surface; and a fourth current supply leg connected to a first end region of the third electron emission surface, wherein the first, second, third, and fourth current supply legs have current supplied from a heating current supply source, and the heating current supply source supplies the current directly to the first, second, third, and fourth current supply legs, respectively.

2. The flat filament according to claim 1, wherein heat radiation areas of reduced heat conduction are formed in the second electron emission surface adjacent a connection thereof to the first electron emission surface, and in the third electron emission surface adjacent a connection thereof to the first electron emission surface.

3. The flat filament according to claim 2, wherein the heat radiation areas are areas having bores formed in the second electron emission surface and the third electron emission surface.

4. The flat filament according to claim 1, further comprising:

a fourth electron emission surface disposed laterally of the second electron emission surface, opposite from the first electron emission surface, and connected to the second end region of the second electron emission surface;

a fifth current supply leg connected to a first end region of the fourth electron emission surface;

a fifth electron emission surface disposed laterally of the third electron emission surface, opposite from the first electron emission surface, and connected to the first end region of the third electron emission surface; and a sixth current supply leg connected to a second end region of the fifth electron emission surface, wherein the fifth and sixth current supply legs have the current supplied from the heating current supply source.

5. The flat filament according to claim 4, wherein heat radiation areas of reduced heat conduction are formed in the fourth electron emission surface adjacent a connection thereof to the second electron emission surface, and in the fifth electron emission surface adjacent a connection thereof to the third electron emission surface.

6. The flat filament according to claim 5, wherein the heat radiation areas are areas having bores formed in the fourth electron emission surface and the fifth electron emission surface.

7. An X-ray tube having a cathode with a flat filament for generating an electron beam, and an anode for generating X-rays upon collision with the electron beam generated from the cathode, wherein the flat filament includes:

a first electron emission surface;

a first current supply leg connected to a first end region of the first electron emission surface;

a second current supply leg connected to a second end region opposite from the first end region of the first electron emission surface;

a second electron emission surface disposed laterally of the first electron emission surface and connected to the first end region of the first electron emission surface;

a third current supply leg connected to a second end region of the second electron emission surface;

a third electron emission surface disposed laterally of the first electron emission surface, opposite from the second electron emission surface, and connected to the second end region of the first electron emission surface; and a fourth current supply leg connected to a first end region of the third electron emission surface, the X-ray tube comprises a heating current supply source to supply heating current to the first, second, third, and fourth current supply legs, the heating current supply source being configured to supply the heating current selectively to the first and second current supply legs and to the third and fourth current supply legs, and the heating current supply source supplies the heating current directly to the first, second, third, and fourth current supply legs, respectively.

8. The X-ray tube according to claim 7, wherein heat radiation areas of reduced heat conduction are formed in the second electron emission surface adjacent a connection thereof to the first electron emission surface, and in the third electron emission surface adjacent a connection thereof to the first electron emission surface.

9. The X-ray tube according to claim 8, wherein the heat radiation areas are areas having bores formed in the second electron emission surface and the third electron emission surface.

10. The X-ray tube according to claim 7, wherein the flat filament further includes:

a fourth electron emission surface disposed laterally of the second electron emission surface, opposite from the first electron emission surface, and connected to the second end region of the second electron emission surface;

a fifth current supply leg connected to a first end region of the fourth electron emission surface;

a fifth electron emission surface disposed laterally of the third electron emission surface, opposite from the first electron emission surface, and connected to the first end region of the third electron emission surface; and a sixth current supply leg connected to a second end region of the fifth electron emission surface, wherein the fifth and sixth current supply legs have the heating current supplied from the heating current supply source.

11. The X-ray tube according to claim 10, wherein heat radiation areas of reduced heat conduction are formed in the fourth electron emission surface adjacent a connection thereof to the second electron emission surface, and in the fifth electron emission surface adjacent a connection thereof to the third electron emission surface.

12. The flat filament according to claim 11, wherein the heat radiation areas are areas having bores formed in the fourth electron emission surface and the fifth electron emission surface.

13. An X-ray tube of envelope rotation type having a cathode with a flat filament for generating an electron beam, an anode for generating X-rays upon collision with the electron beam generated from the cathode, a deflection coil for controlling a focal position where the electron beam collides with the anode by deflecting the electron beam generated from the cathode, and an envelope containing the cathode and the anode, the anode being rotatable with the envelope, wherein the flat filament includes:

a first electron emission surface;

a first current supply leg connected to a first end region of the first electron emission surface;

a second current supply leg connected to a second end region opposite from the first end region of the first electron emission surface;

a second electron emission surface disposed laterally of the first electron emission surface and connected to the first end region of the first electron emission surface;

a third current supply leg connected to a second end region of the second electron emission surface;

a third electron emission surface disposed laterally of the first electron emission surface, opposite from the second electron emission surface, and connected to the second end region of the first electron emission surface; and a fourth current supply leg connected to a first end region of the third electron emission surface, the X-ray tube comprises a heating current supply source to supply heating current to the first, second, third, and fourth current supply legs, the heating current supply source being configured to supply the heating current selectively to the first and second current supply legs and to the third and fourth current supply legs, and the heating current supply source supplies the heating current directly to the first, second, third, and fourth current supply legs, respectively.

14. The X-ray tube according to claim 13, wherein heat radiation areas of reduced heat conduction are formed in the second electron emission surface adjacent a connection thereof to the first electron emission surface, and in the third electron emission surface adjacent a connection thereof to the first electron emission surface.

15. The X-ray tube according to claim 14, wherein the heat radiation areas are areas having bores formed in the second electron emission surface and the third electron emission surface.

16. The X-ray tube according to claim 13, wherein the flat filament further includes:

a fourth electron emission surface disposed laterally of the second electron emission surface, opposite from the first electron emission surface, and connected to the second end region of the second electron emission surface;

a fifth current supply leg connected to a first end region of the fourth electron emission surface;

a fifth electron emission surface disposed laterally of the third electron emission surface, opposite from the first electron emission surface, and connected to the first end region of the third electron emission surface; and a sixth current supply leg connected to a second end region of the fifth electron emission surface, wherein the fifth and sixth current supply legs have the heating current supplied from the heating current supply source.

17. The X-ray tube according to claim 16, wherein heat radiation areas of reduced heat conduction are formed in the fourth electron emission surface adjacent a connection thereof to the second electron emission surface, and in the fifth electron emission surface adjacent a connection thereof to the third electron emission surface.

18. The flat filament according to claim 17, wherein the heat radiation areas are areas having bores formed in the fourth electron emission surface and the fifth electron emission surface.

19. The flat filament according to claim 1, wherein the second electron emission surface is connected directly to the first end region of the first electron emission surface, and the third electron emission surface is connected directly to the second end region of the first electron emission surface.

20. The X-ray tube according to claim 7, wherein the second electron emission surface is connected directly to the first end region of the first electron emission surface, and the third electron emission surface is connected directly to the second end region of the first electron emission surface.

21. The X-ray tube according to claim 13, wherein the second electron emission surface is connected directly to the first end region of the first electron emission surface, and the third electron emission surface is connected directly to the second end region of the first electron emission surface.

* * * * *